US009732738B2

(12) United States Patent
Abousaleh

(10) Patent No.: US 9,732,738 B2
(45) Date of Patent: Aug. 15, 2017

(54) PISTON PUMP COMPRISING FLAT GUIDING

(75) Inventor: Khaled Abousaleh, Paris (FR)

(73) Assignee: PULSSAR TECHNOLOGIES, Paris (FR)

( * ) Notice: Subject to any disclaimer, the term of this patent is extended or adjusted under 35 U.S.C. 154(b) by 407 days.

(21) Appl. No.: 14/111,353

(22) PCT Filed: Apr. 3, 2012

(86) PCT No.: PCT/FR2012/050714

§ 371 (c)(1),
(2), (4) Date: Oct. 15, 2013

(87) PCT Pub. No.: WO2012/140346

PCT Pub. Date: Oct. 18, 2012

(65) Prior Publication Data

US 2014/0033914 A1 Feb. 6, 2014

(30) Foreign Application Priority Data

Apr. 12, 2011 (FR) ..... 11 53165

(51) Int. Cl.

| | |
|---|---|
| ***F04B 17/00*** | (2006.01) |
| ***F04B 1/00*** | (2006.01) |
| ***F04B 9/02*** | (2006.01) |
| ***F04B 9/04*** | (2006.01) |
| ***F04B 13/00*** | (2006.01) |
| ***F04B 17/03*** | (2006.01) |

(52) U.S. Cl.

CPC ..... *F04B 1/00* (2013.01); *F04B 9/02* (2013.01); *F04B 9/04* (2013.01); *F04B 9/047* (2013.01); *F04B 13/00* (2013.01); *F04B 17/03* (2013.01)

(58) Field of Classification Search

CPC ..... F04B 9/047; F04B 43/04
USPC ..... 417/415, 437, 360, 212, 215, 363, 362, 417/361, 365, 367; 92/165 PR; 222/261
See application file for complete search history.

(56) References Cited

U.S. PATENT DOCUMENTS

| | | | | |
|---|---|---|---|---|
| 6,234,771 | B1 * | 5/2001 | Carey | F04B 17/03 417/360 |
| 2005/0158191 | A1 * | 7/2005 | Autrey | F04B 9/02 417/415 |
| 2008/0152515 | A1 * | 6/2008 | Karg | F04B 35/045 417/415 |

(Continued)

FOREIGN PATENT DOCUMENTS

| | | | |
|---|---|---|---|
| EP | 1 489 261 | A1 | 12/2004 |

OTHER PUBLICATIONS

International Search Report, dated May 31, 2012, from corresponding PCT application.

*Primary Examiner* — Michael Leslie
*Assistant Examiner* — Dustin T Nguyen
(74) *Attorney, Agent, or Firm* — Young & Thompson

(57) ABSTRACT

A pumping device includes a working chamber and a piston provided to slide in the working chamber so as to vary the useful volume of the chamber during pumping, and anti-rotation elements for the piston. Advantageously, the anti-rotation elements include an index (107) mounted radially with respect to the axis of the piston and the device includes a longitudinal slot (108), the index being provided so as to move in the slot. Advantageously, the index (107) has two approximately parallel planar faces that extend longitudinally.

7 Claims, 3 Drawing Sheets

(56) References Cited

U.S. PATENT DOCUMENTS

Figure 1:
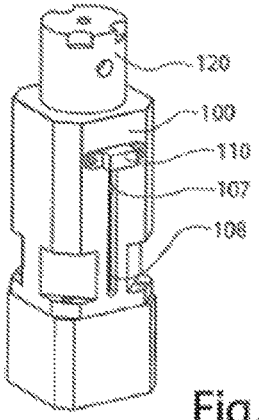

| | | | | |
|---|---|---|---|---|
| 2008/0187449 | A1* | 8/2008 | Breidenbach | F04B 7/06<br>417/499 |
| 2010/0111721 | A1* | 5/2010 | Servin | F04B 23/06<br>417/321 |

* cited by examiner

PISTON PUMP COMPRISING FLAT GUIDING

BACKGROUND OF THE INVENTION

The present invention relates to the field of piston pumps used in automatic withdrawals, in particular pumps of the syringe type used to withdraw a blood sample.

DESCRIPTION OF THE RELATED ART

A piston pump comprises a work chamber and a piston slidingly mounted in the chamber. The work chamber is connected to withdrawal means such as a line and a needle. The volume of the chamber is varied, depending on whether one wishes to suction or discharge the withdrawn sample, by moving the piston.

These pumps are generally used to withdraw very small sample quantities, which requires considerable precision in the volumes, and therefore the positioning and movement of the piston. Generally, the sample itself does not penetrate the chamber, which, like the line, is occupied by an intermediate liquid that acts as a liquid piston.

The piston is generally translated by a screw that is engaged on a threaded bush rigidly secured to the piston and situated in the extension thereof, the screw in turn being driven by a motor, for example a stepping motor. One drawback of this assembly is that the screw tends to rotate the piston around its axis if its rotation is not blocked. Another problem arises from the fact that the seal providing sealing between the piston and the work chamber does not make it possible to ensure precise enough guiding of the piston in its movement and the latter may slightly tilt in a rotational movement orthogonal to its axis.

SUMMARY OF THE INVENTION

The invention aims to resolve these problems. To that end, it proposes a pumping device, which may comprise a work chamber and a piston provided to slide in said work chamber so as to vary the working volume of the chamber during pumping, characterized in that it comprises anti-rotation means of the piston.

The anti-rotation means make it possible to ensure that the piston will only be driven in an axial translational movement.

Advantageously, the anti-rotation means may comprise an index radially mounted relative to the axis of the piston and the device may comprise a longitudinal slit, said index being provided to move in said slit.

The pumping device comprises an index protruding transversely relative to the piston axis and a rectilinear guide slit, parallel to the axis of the piston, for example formed in the body of the pump. The index that moves in this guide slit ensures that the piston will not be rotated by the screw. Of course, the transverse extension of the index is equal to or very slightly smaller than the width of the guide slit, such that it can slide freely.

Advantageously, the index may comprise two substantially parallel planar faces that extend longitudinally.

When the index has a small longitudinal extension, for example when it is a cylindrical pin, the friction surface between the index and the flanks of the guide slit is small, which creates rapid wear of the index and/or the flanks of the slit. To prevent this wear, it is advantageous to give a certain longitudinal extension to the index, for example to equip it with two parallel and longitudinal planar faces, those faces sliding along the flanks of the slit and reducing the friction.

Advantageously, the pumping device may comprise at least one end-of-travel detecting means situated near one end of the slit.

The pumping device is generally provided with at least one end-of-travel detection means to stop the motor and prevent any end-of-travel deterioration. This end-of-trouble detector may be situated at any carefully chosen location of the pump, but it may advantageously be situated near one end of the slit, in particular the end close to the work chamber.

Advantageously, the slit is extended by a cavity, the end-of-travel detector being provided to penetrate the cavity when it reaches the end of its travel.

In certain assemblies, the slit communicates, at that end near the working chamber, with an area with a greater width than the slit, but limited longitudinal extension, provided to receive an end-of-travel detector.

If the index has a small bulk, for example a pin, it may completely leave the slit, penetrating the detection area, and no longer perform its anti-rotation function of the piston.

Advantageously, the longitudinal extension of the index is greater than the distance between the end of the slit and the end-of-travel detection area of the index.

The cavity may assume any shape, but generally has a rectangular section, with a width larger than that of the slit and a limited longitudinal extension.

The detection area must be understood as the point, direction or surface which, when reached by the index, causes the end-of-travel signal by the detector.

These arrangements make it possible for the index to remain engaged on the flanks of the slit—and therefore continue to perform its anti-rotation function—when the detection occurs.

Furthermore, during the inverse movement of the piston, the index does not risk abutting on the narrowing constituted by the passage from the cavity to the slit.

Advantageously, the anti-rotation means further comprise a partition situated upstream from the work chamber and through which the piston is provided to slide.

The piston crosses through a partition of the body of the pump before reaching the work chamber. The thickness of this partition is sufficient to guide the piston axially, i.e., to prevent any tilting movement thereof transverse to its axis.

Advantageously, the piston is driven in translation by a screw engaged on a bush, and the pumping device further comprises means for canceling the play between said screw and said bush.

As seen above, the piston is translated by a screw that is engaged on a threaded bush. This assembly is generally a source of play and therefore imprecision in the measurement. It is therefore advantageous to provide means for canceling out that play. The invention proposes two alternatives.

In a first alternative, the screw is a ball screw. Ball screws are known for eliminating the play between the screw and the part unscrewed above it, but the use of such an assembly in the present pump is atypical in that the ball screw is only maintained by a single bearing, situated at the end of the screw close to the motor.

In the second alternative, the screw is a traditional threaded screw and the pump further comprises means for compensating play between said screw and said bush, in particular a spring.

A spring continuously puts the same faces of the threads of the screw and the bush in contact, canceling the play between those two elements.

BRIEF DESCRIPTION OF THE DRAWING FIGURES

Figure 2A:
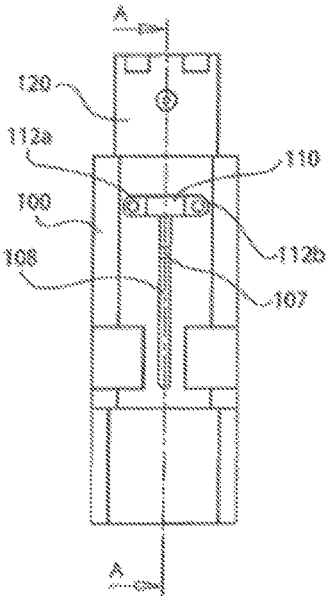
Figure 2B:
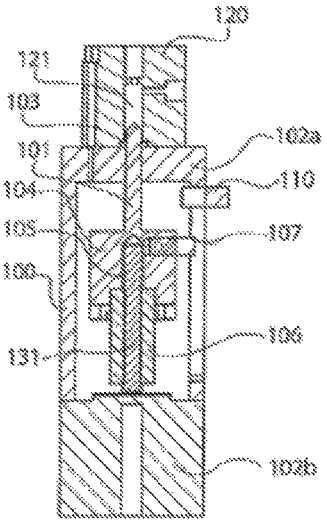
Figure 2C:
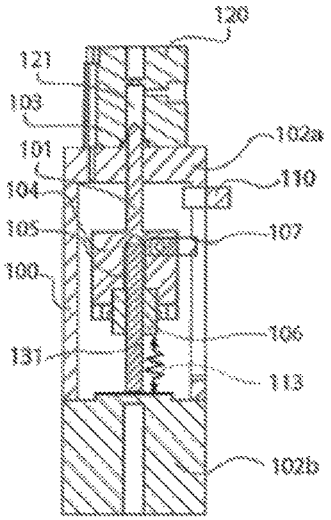
Figure 3:
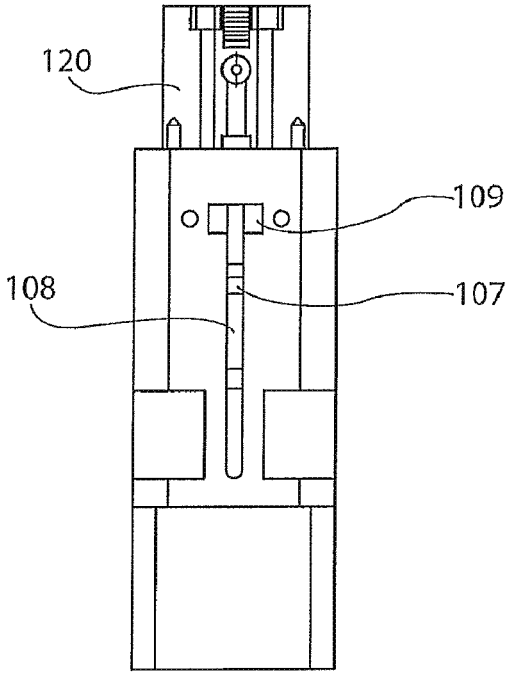
Figure 4:
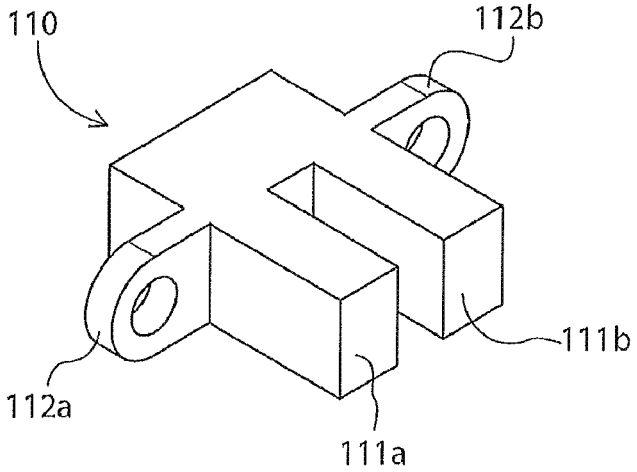
Figure 5:
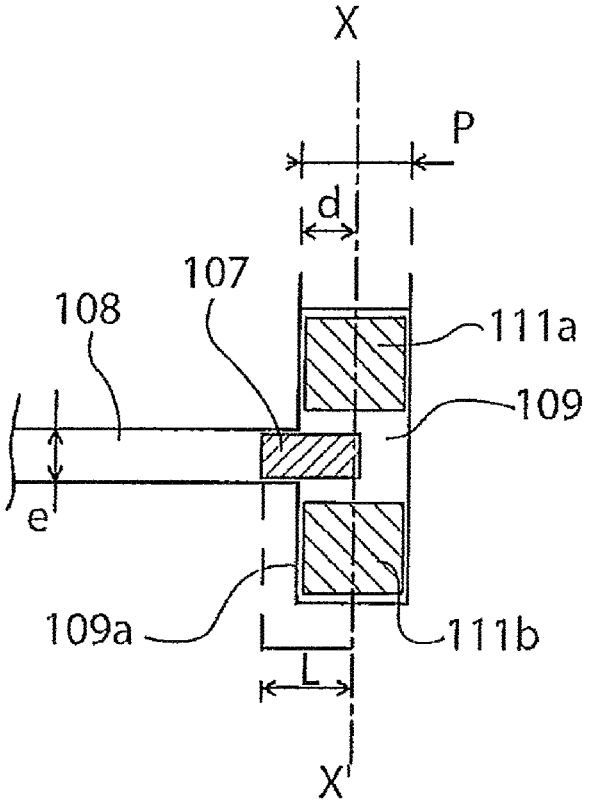

Embodiments and alternatives will be described hereinafter, as non-limiting examples, in reference to the appended drawings, in which:

FIG. 1 shows a perspective view of a pump,

FIGS. 2A, 2B and 2C respectively show a pump in planar top view and longitudinal cross-sectional view along A-A, FIG. 3 shows the pump in planar top view without an end-of-travel detector, FIG. 4 shows an end-of-travel detector in perspective view, FIG. 5 shows an enlarged longitudinal cross-section at the end of the slit of the pump.

DETAILED DESCRIPTION OF THE INVENTION

The pump illustrated in FIGS. 1, 2A and 2B comprises a body 100 with a substantially parallelepiped shape with cut-out panels, topped by a work compartment 120 fixed on a transverse face of the body 100. The body 100 contains a piston 101 that is slidingly mounted within the body 100. The piston passes through the partition 102*a*, which adjoins the work compartment 120, and emerges in a work chamber 121 formed within that compartment. A seal 103, situated at the junction of the work chamber 121 and the body 100, ensures sealing around the piston 101. On the side of the work compartment 120, at least one line (not shown) is fixed to the pump and communicates with the work chamber.

The movement of the piston modifies the working volume of the work chamber 121. If this work chamber is filled with a liquid, causing the piston to penetrate it drives the liquid into the line, and withdrawing the piston suctions liquid in the line. This liquid may serve as an intermediary or "liquid piston" between the piston 121 of the pump and a sample to be withdrawn.

The piston 101 is rigidly secured to a support 104 situated in the body 100, in which a cavity 105 is formed axially aligned with the piston 101. Opposite the piston 101, the support 104 is rigidly fastened on a threaded bush 106 coaxial with the cavity 105. The screw 131 of the motor 102*b* is placed in the cavity 105 and in the threaded bush 106. The screw illustrated in FIG. 2B is a ball screw engaged on a suitable sleeve 106. This ball screw has the particularly, in this application, of being used without any bearing remote from the motor 102*b*.

In another embodiment, the screw 131 is a traditional threaded screw, but the play between the screw and the sleeve 106 is canceled owing to a spring 113 (shown schematically in FIG. 2C) that continuously biases the sleeve in the same axial direction, so as to eliminate the play between the screw and the threaded sleeve.

An index 107 extends radially from the support 104 and is positioned in a slit 108 formed in one face of the body 100, but without protruding relative to that face of the body 100. The index has a substantially rectangular transverse section, the small side being substantially equal to the width e of the slit 108 so as to slide without friction in the slit. In this way, the index prevents the support 104 and therefore the piston 101 from rotating on its axis when the spindle 131 is actuated in rotation by the motor, only a translational movement being possible.

At its end near the work compartment 120, the slit 108 is extended by a cavity 109 delimiting a wider area with a substantially rectangular shape. This cavity is intended to receive an end-of-travel detector of the piston, by means of the entry into that area of the index 107.

FIG. 4 illustrates one such end-of-travel detector in the form of an optical detector 110 or optical jumper. This optical jumper 110 comprises two substantially parallel branches 111*a* and 111*b*, one of the branches being provided on its inner face with an optical transmitter (not shown), for example a diode, the other branch being provided on its opposite face with an optical detector (not shown), which are aligned along an optical axis X-X' substantially orthogonal to the branches 111*a*, 111*b*. The optical detector 110 further comprises two fastening tabs 112*a* and 112*b*, situated on either side of the detector in a same plane orthogonal to the branches 111*a*, 111*b*. The fastening tabs each comprise a through opening for using a screw to fasten the optical jumper 110 on a longitudinal face of the body 100 of the pump.

The branches 111*a*, 111*b* of the detector are provided to be placed in the cavity 109 of the body 100, on either side of the axis of the slit 108, such that the space comprised between the branches 111*a* and 111*b* enters the extension of the slit 108. When it reaches the end of travel, i.e., the end of the slit 108, the index 107 therefore passes between the branches 111*a* and 111*b* of the detector and interrupts the optical beam.

FIG. 5 shows a cross-section of an index 107 arriving at the end of travel in the slit 108. The front face of the index passes through the optical axis X-X' of the optical jumper 110 between its branches 111*a* and 111*b*, which causes the pump to stop and the progression of the index to end. The longitudinal extension or length L of the index 107 is greater than the distance d between the end of the slit 108 and the optical axis X-X'. In this way, the index 107 remains engaged on the flanks of the slit 108 until the end of travel is detected and therefore continues to play its anti-rotation role with respect to the piston 101, even if the separation between the opposite faces of the branches 111*a*, 111*b* of the optical sensor is greater than the width e of the slit 108.

This arrangement procures another advantage: when the index 107 moves away from the sensor 110 after reaching its end of travel, it does not risk being blocked against the face 109*a* of the cavity 109 adjacent to the end of the slit 108, which would risk deteriorating the pump.

The figures illustrate the use of an optical jumper 110, but the invention is not limited to such a detector. Many detectors are covered by the invention, for example a contact detector, provided the length L of the index is greater than the distance between the end of the slit 108 and the end-of-travel detection point. This condition will always be met if the length L of the index is greater than the depth P of the cavity 109.

It is also appropriate for the piston 101 to be guided in rotation transverse to its axis, so as to prevent any tilting movement of said piston. This transverse guiding is done by the partition 102*a* passed through by the piston 101, said partition to that end being provided with a sufficient thickness.

The invention claimed is:

1. A pumping device, comprising:

a body (100) with an upper end, a lower end, and a wall with an inner surface extending between the lower and upper ends that defines an interior volume of the body (100), the upper end of the body having an end wall extending across the interior volume of the body (100), the end wall having a first opening that extends through the end wall;

a longitudinal slit (108) extending upwardly through the wall of the body (100) from the inner surface to an exterior surface of the wall and from a lower part of the body (100) to an upper part of the body (100);

a work compartment (120) fixed on an upper end face of the upper end of the body (100), the work compartment (120) having a second opening vertically aligned with the first opening of the body;

a work chamber (121) within the work compartment (120), the work chamber (121) extending from the second opening of the work compartment (120);

a piston (101) slidingly mounted within the interior volume of the body (100) in vertical alignment below the work chamber (121), where during an upward movement of the piston, the piston moves through the first opening at the upper end of the body (100) and emerges in the work chamber (121) within the work compartment (120), wherein movement of the piston (101) modifies a working volume of the work chamber (121);

a seal (103) situated at a junction of the first opening of the body (100) and the second opening of the work chamber (121), wherein the piston passes through a center of the seal with the seal (103) pressing against the piston, and during the upward movement of the piston, an exterior portion of the piston moves against a center portion of the seal;

a support (104) situated within the interior volume of the body (100) in vertical alignment below the work chamber (121), the piston (101) being secured to an upper part of the support (104); and an anti-rotation index (107) that extends radially relative to the axis of the piston (101), within the interior volume of the body (100), from the support (104) into the longitudinal slit (108), said index being movable in the longitudinal slit (108) with the movement of the piston (101), the index (107) preventing the support (104) and the piston (101) from rotating and allowing only translational movement of the support (104) and the piston (101).

2. The pumping device according to claim 1, further comprising:

a cavity (105) within the support, the cavity (105) being axially aligned with the piston (101);

a bush (106) fastened to a lower part of the support (104) and coaxial with the cavity (105); and a motor (102*b*) with a screw (131), the screw (131) located within the cavity (105) and in the bush (106), the screw (131) driving the piston (101) in translation.

3. The pumping device according to claim 2, wherein said screw (131) is a ball screw.

4. The pumping device according to claim 2, wherein said screw (131) is a threaded screw, and the bush is comprised of a sleeve, the sleeve being biased by a spring (113) to cancel play between the screw and the sleeve, the spring continuously putting the same faces of threads of the screw and the bush in contact, canceling play between the screw and the bush.

5. The pumping device according to claim 1, wherein said index (107) comprises two substantially parallel planar faces that extend longitudinally.

6. The pumping device according to claim 1, further comprising:

an end-of-travel detector (110) situated near one end of the slit (108), the end-of-travel detector comprising two parallel branches (111*a*, 111*b*);

a cavity (109) located at an upper end of said slit (108), the cavity (109) having first and second ends that extend a width of the slit (108), wherein the end-of-travel detector (110) extends into the first and second ends of the cavity (109), on each side of an axis of the slit (108), wherein a longitudinal extension (L) of the index (107) is greater than a distance (d) between the upper end of the slit (108) and an end-of-travel detection area of the index, and the two parallel branches (111*a*, 111*b*) of the end-of-travel detector extend into the cavity (109), the end-of-travel detector (110) be triggered by a portion of the index (107) that extends into the longitudinal slit (108) moving into the cavity (109) and between the two parallel branches (111*a*, 111*b*) of the end-of-travel detector.

7. The pumping device according to claim 1, further comprising:

a cavity (109) located at an upper end of said slit (108), the cavity (109) having first and second ends that extend a width of the slit (108);

an end-of-travel optical detector (110) with a first branch that extends into the first end of the cavity (109) and a second branch that extends into the second end of the cavity (109) and detects when the index (107) is located between the first and second branches of the end-of-travel optical detector (110).

* * * * *